US006634815B2

(12) United States Patent
Burikov et al.

(10) Patent No.: US 6,634,815 B2
(45) Date of Patent: Oct. 21, 2003

(54) LARGE FORMAT INK-JET COLOR PRINTER

(75) Inventors: Vladislav Sergeevich Burikov, Moscow (RU); Alexandr Viktorovich Bokarev, Moscow (RU); Igor Vyacheslavovich Burikov, Moscow (RU); Vladimir Vasilievich Kozlov, Moscow (RU)

(73) Assignee: Igor Dmitrievich Erastov, Moskovskaya oblast (RU)

( * ) Notice: Subject to any disclaimer, the term of this patent is extended or adjusted under 35 U.S.C. 154(b) by 0 days.

(21) Appl. No.: 09/924,421

(22) Filed: Aug. 8, 2001

(65) Prior Publication Data

US 2001/0045970 A1 Nov. 29, 2001

Related U.S. Application Data

(63) Continuation of application No. 09/509,294, filed on Jun. 7, 2000, now Pat. No. 6,341,839, which is a continuation of application No. PCT/RU98/00292, filed on Sep. 17, 1998.

(30) Foreign Application Priority Data

Sep. 23, 1997 (RU) ..... 97116069

(51) Int. Cl.[7] ..... B41J 11/22; B41J 2/175; B41J 2/215; B41J 3/60

(52) U.S. Cl. ..... 400/354; 400/352; 400/188; 347/37; 347/38; 347/50

(58) Field of Search ..... 347/38, 37, 41, 347/50, 86, 97, 21; 400/352, 354, 31, 188, 605, 609, 611

(56) References Cited

U.S. PATENT DOCUMENTS

| | | | | |
|---|---|---|---|---|
| 4,999,651 | A | 3/1991 | Duffield et al. | 346/140 R |
| 5,070,410 | A | 12/1991 | Hadley | 358/296 |
| 5,376,957 | A | 12/1994 | Gandy et al. | 347/3 |
| 5,688,057 | A | 11/1997 | Wright et al. | 400/82 |
| 6,341,839 | B1 * | 1/2002 | Burikov et al. | 347/37 |

FOREIGN PATENT DOCUMENTS

| | | |
|---|---|---|
| EP | 0 400 652 A2 | 12/1990 |
| EP | 0 629 503 B1 | 12/1994 |
| SU | 1060098 A | 12/1983 |

* cited by examiner

*Primary Examiner*—Daniel J. Colillia
(74) *Attorney, Agent, or Firm*—Jenkens & Gilchrist, P.C.

(57) ABSTRACT

The present invention pertains to the field of ink-jet printers used for color printing of large format articles This invention is used for improving quality and for increasing the yield of printers and comprises successively applying primary colors, suppressing color aberrations when printing a semi-transparent material on both sides, precisely positioning the head when printing an image on the substrate and eliminating the lines connecting the carriage to the systems supplying control signals, air and inks. To this end, the carriage with the jet heads is moved in one direction along a closed guiding rail which is fitted with a hatched ruler for precise positioning, wherein the heads will thus bypass the substrate on both sides while information is transmitted from the device control unit to the carriage using a radio transceiver. The printer can further be equipped with two independent and parallel substrate feeding systems for performing a one-sided printing on two substrates at the same time.

45 Claims, 3 Drawing Sheets

LARGE FORMAT INK-JET COLOR PRINTER

This application is a continuation of U.S. patent application Ser. No. 09/509,294, filed Jun. 7, 2000, now U.S. Pat. No. 6,341,839, which is a continuation of Application No. PCT/RU98/00292 filed Sep. 17, 1998, now issued as PCT Patent No. WO 99/15336 on Apr. 1, 1999 and Russian Application No. 97116069 filed on Sep. 23, 1997.

FIELD OF THE INVENTION

The invention relates to the field of ink-jet printers used for colour printing of large format articles used, in particular, in the advertisement industry.

BACKGROUND ART

A specific feature of the utilization of ink-jet printers used for colour printing of large format articles is the production of large size images (up to tens of square meters) of sufficiently high quality at relatively low cost, which is attained by creating highly-productive machines with relatively low resolution of the produced images (usually 18–36 lines per inch). In a principle respect these devices are not distinctive over ordinary printers that are widely used as documenting devices in personal computers (PC).

A typical representative of such devices is an ink-jet printing head and a printer comprising a paper feeding device, a carriage executing reciprocal movement along a paper substrate, and a removable jet head with a reserve of ink that is mounted on the carriage (EP, A2 0400652, 1990, B 41 J 2/07). The head is made in the form of an autonomous unit having an electronic unit in which information relating to the mutual positioning of the drawing nozzles in the head is entered. These nozzles are used by the control program of the PC when information is fed from the PC to the printer.

The process of drawing is carried out by supplying energy to each nozzle of the head in the form of an electrical pulse which is converted into heat sufficient to discharge a portion of ink from the nozzle. Furthermore, a system for synchronizing the position of the head relative to the substrate and the information being presented is used in the printer.

From a principle point of view, all printers operate according to this arrangement, differing only by the method of applying the image (either by heat, or hydraulic impact, or blast of air, etc.)

All of the basic elements of such printers are present in the device disclosed in the patent U.S. Pat. No. 4,999,651, 1991, G 01 D 15/16. In a colour recorder, ink cartridges are positioned on a common carriage that effects reciprocal movement. There are also intermediate working cartridges in which the level of the ink is maintained virtually constant, which ensures the highest quality of the images being reproduced. Furthermore, the device contains an electronic unit which holds the image being reproduced in its memory and controls the operation modes of the device.

The presence of an intermediate unit for storing the information to be applied makes it possible to separate in time the generation of images in a PC (for example, by scanning photographic images and then editing them, or producing images by machine graphic methods, etc.) and their transfer to the substrate. Furthermore, the volume of the information stored in the device only depends on its own capabilities and is in no way related to the PC, which makes it possible to use this device in network systems.

The presence of ink cartridges directly on the carriage simplifies the construction of the device, ensuring at the same time the possibility of obtaining a larger volume of graphic material without frequently recharging the device. As already noted above, the presence of an intermediate service cartridge ensures a constant level of the ink, which promotes effective operation of the jet elements and a high quality of the images being reproduced.

A device is known that serves to obtain a direct image on one side of a sheet and a mirror image on the other side, which makes it possible to obtain a high quality image on a semi-transparent material (U.S. Pat. No. 5,376,957, 1994, B 41 J 2/045). This device is provided with an ink-feeding mechanism with two carriages positioned on opposite sides of a substrate. Control of the operation of the device and, in particular, the carriages and heads, is carried out with the aid of a unit for control and storage of the direct and mirror images being formed. By means of a scanner, information is entered into a computer which edits the image and encodes the print density of each colour in the form of electrical current pulses of different width, which control electric valves of the atomizers of the jet heads of each colour, which are on the ink-jet printing device. Thus, the density of each colour is determined by the width of the pulse generated by the PC. Specific features of the operation of ink-jet elements of the heads are that the air stream entering the working nozzle of the jet element consists of two streams: one—continuous, creating a constant stream of air in the nozzle, which ensures that the ink in the supply channel does not dry and hinders the formation of parasitic drops at the end of that channel, and the second—controlled with the aid of an air valve which opens an additional stream of air, ensuring the supply of ink to the substrate in accordance with the width of the control pulses. In order to ensure reliable adhesion and drying and to exclude smearing of the ink, the substrate is heated with spiral heaters which are mounted below and above the carriages in the direction of movement of the substrate. Sponges are also disposed on the carriages, the sponges wiping the substrate before the ink is applied thereon, this ensuring removal of foreign contaminants and also enhancing application of the ink onto the substrate.

However, the presence of lines in each moving carriage should be noted in this construction. These lines consist of a plurality of electrical cables, for control of the valves in the heads, and tubes for feeding the ink. This line increases as the width of the substrate, along which the carriage moves, increases, and this line has to move together with the carriage, which creates a number of technological difficulties and reduces the reliability of operation of the device.

Reciprocal movement of the carriages presumes acceleration to the nominal speed, braking and stopping for each working cycle, which reduces the productivity of the device and requires increased power of the drive mechanisms and corresponding braking dampers. Furthermore, with horizontal positioning of the heads of different colours from the left to the right and from the right to the left, the sequence in which the primary colours are applied is disturbed, which results in "striping" (by shade) of the obtained images. There is also a problem in obtaining quality two-sided images, the solution to this problem not being found in prior art. In particular, different heads, positioned on different carriages, are used in the making of direct and mirror images. It is virtually impossible to ensure their complete identicality in operation. Therefore, when two-sided images are being produced, distortions inevitably occur in the colour reproduction, and this affects the quality of the article.

DISCLOSURE OF THE INVENTION

The problems being solved in the invention are the following:

liquidation of the lines connecting the carriage to the systems for supplying control signals, air and ink;

ensure the successive application of the primary colours;

suppression of colour aberrations when printing a semi-transparent substrate on both sides;

ensure the precise application of the ink onto the substrate;

ensure the possibility of simultaneously performing one-sided printing on two substrates.

In order to achieve the aforesaid technical results, the construction of a large format ink-jet colour printer is proposed which comprises a substrate feeding system, an ink feeding mechanism which is movable along a closed guiding rail relative to the substrate, this making it possible for heads to travel around the substrate on two sides, and a printer control unit. Shafts in the substrate feeding system are positioned in a vertical plane, wherein tensioning shafts, connected to reversible motors by means of magnetic clutches, are positioned above and below the feeding shaft provided with a reversible motor. The ink feeding mechanism, movable along the closed guiding rail is provided with at least one carriage with brushes for supplying electric power, with a receiver to be filled with air from an external source by means of a rapidly-released catch, with a controller provided with a transceiver, and with an optical sensor electrically coupled to the controller. The guiding rail is provided with busbars for supplying electric power and with a hatched ruler for exactly positioning the carriage. Wherein, electrical valves connected to the printer control unit are mounted between the charging cartridges, positioned on the carriage and having a level sensor, and the rapidly-released catches of the system for recharging those cartridges. The rapidly-released catches are positioned in places where the guiding rail turns. In order to increase the productivity there may be two and more of such carriages. The carriages move at a constant speed, which reduces the power of the drive mechanisms and eliminates the need for dampers, since movement of the carriages takes place in one direction (for example, in the clockwise direction), removes the question of "striping" in the obtained images, and the colour palette of the direct and mirror images is also the same. Wherein, full autonomy of the carriage is ensured upon its movement over the working sections of the substrates.

The printer may have a second substrate feeding system, independent of the first, wherein both parallel positioned substrate systems are encompassed by the closed guiding rail. Thus, an image may be obtained simultaneously on two substrates which are inside the closed guiding rail, this substantially expanding the consumer properties of the device and enhancing its productivity.

BRIEF DESCRIPTION OF THE DRAWINGS

FIG. 1 shows a general perspective of a device with one substrate feeding system;

FIG. 2 shows the mutual positioning of the guiding rail, busbars and substrate;

FIG. 3 shows the arrangement of the main units of the ink feeding mechanism;

FIG. 4 shows a perspective of the rapidly-released connections in the device;

FIG. 5 shows a general diagram of a device with two substrate feeding systems.

BEST METHOD OF CARRYING OUT THE INVENTION

Figure 1:
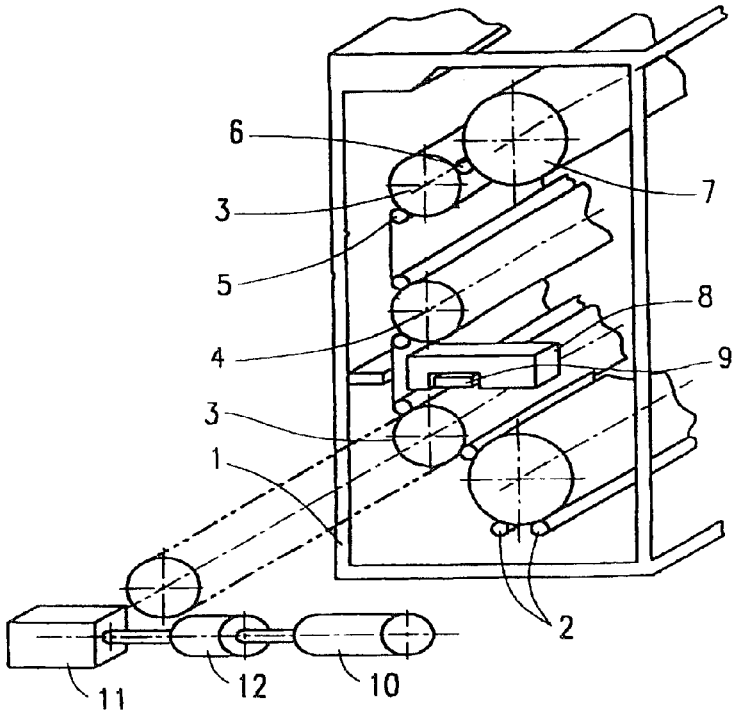
FIGS. 1, 2, 3, 4, 5 illustrate the construction of the device.
Figure 2:
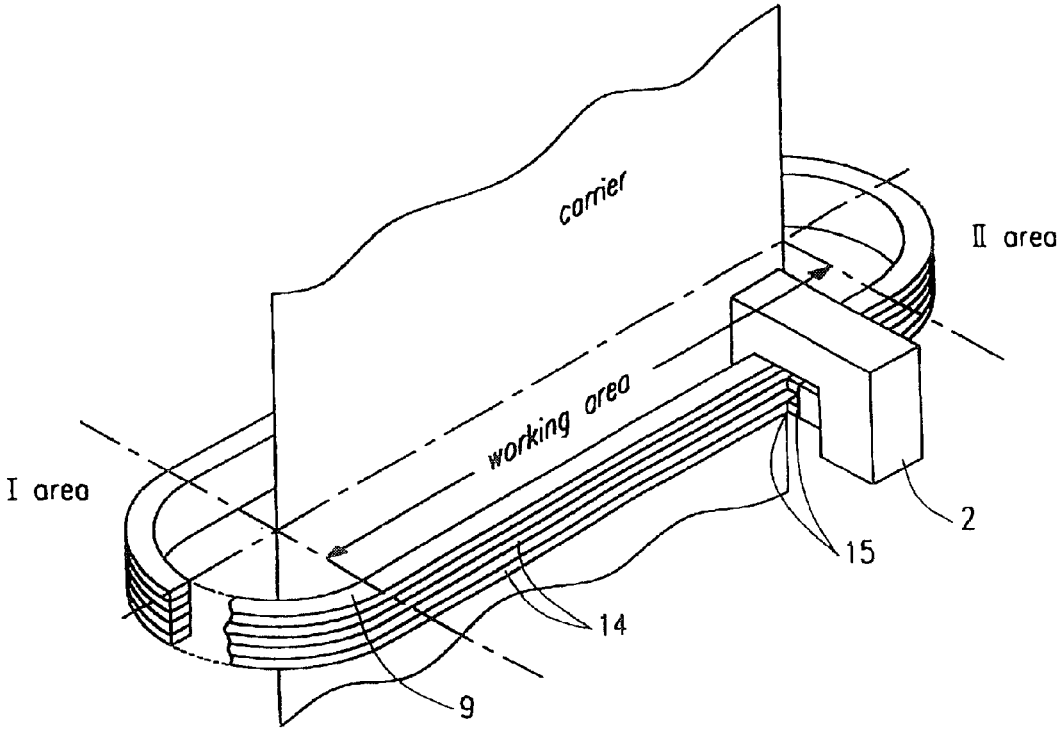
Figure 3:
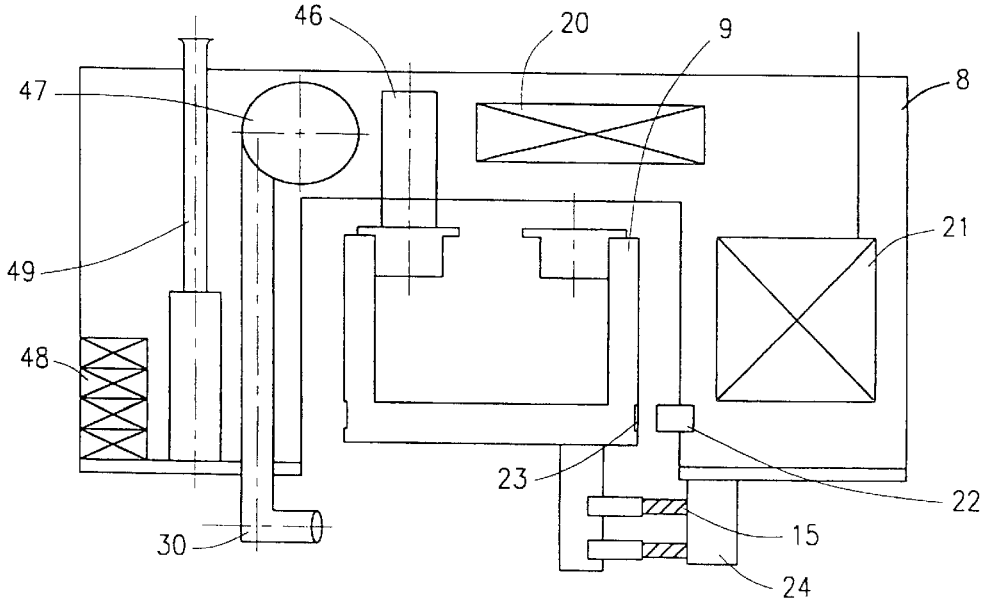
Figure 4:
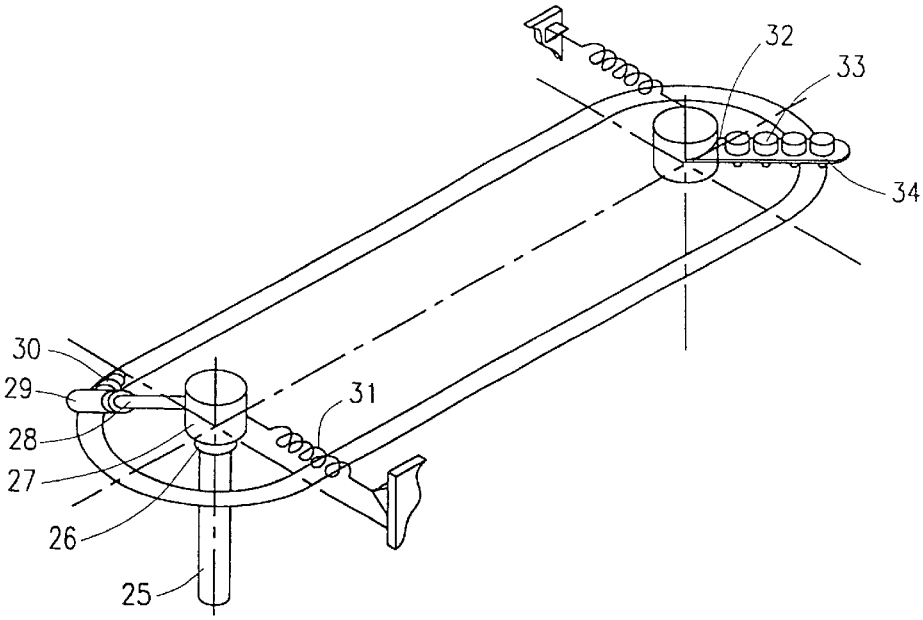

The large format ink-jet colour printer (FIG. 1) consists of a frame (1), rollers (2) for feeding a carrier, tensioning shafts (3), a feeding shaft (4), guiding rollers (5), pressing rollers (6), a receiving shaft (7), a carriage (8), a guiding rail (9). The tensioning shafts for the substrate are connected to reducers (11) and reversible electric motors (10) by means of magnetic clutches (12). The shafts for receiving and feeding the substrate are connected to reversible drive electric motors via reducers (not shown in FIG. 1). The carriage (8) (FIG. 2) is placed on the closed guiding rail (9) to which copper busbars (14) are secured by means of supports (13) made of a nonconductor. Electrical current is applied to the busbars. By means of brushes (15), electric current is applied to the power supply of the carriage (not shown in the FIG.) and to other power consuming devices. The ink feeding mechanism is shown in FIG. 3. An electric drive (16) for ensuring movement of the carriage (8), a receiver (17) for storing high pressure air for ensuring operation of the jet elements, an assembly of heads (18) with jet elements and charge cartridges (19) for storing ink with level sensors (not shown in FIG. 3), an electric drive control unit (20), an electronic controller (21) for communication over a radio channel with a control unit (not shown in the FIG.) and for ensuring operation of all units of the carriage in the process of developing images, an optical sensor (22) for positioning the carriage relative to the substrate along a hatched ruler (23) positioned on the guiding rail, a brush holder (24) with brushes (15) for supplying power to the carriage are disposed on the carriage (8). Diagrams showing the positioning of rapidly released connections used to recharge the carriages with air and ink are shown in FIG. 4. The air recharging system includes a pipe (25), a supply coupling (26) with a movable tip (27) sitting on the coupling with the possibility of rotating thereon, a carrier arm (28) on which a rapidly-released catch (29) for butt-joining and disengaging with a pipe (30) for charging the carriage receiver is secured. In the initial position the carrier arm 28) is held by a spring (31) secured on the movable tip (27). The ink recharging system is set up in a similar manner, except that ink charging electric valves (33), connected to the charge cartridges for the ink (19), are mounted on a carrier (32). Rapidly-released catches (34) are secured to a lower (output) part of the electric valves (33) and during the recharging are located opposite the necks of the charging cartridges (19) and the assembly of heads with cartridges for ink (18), which are disposed on the carriage (8).

The device operates in the following manner.

Figure 5:
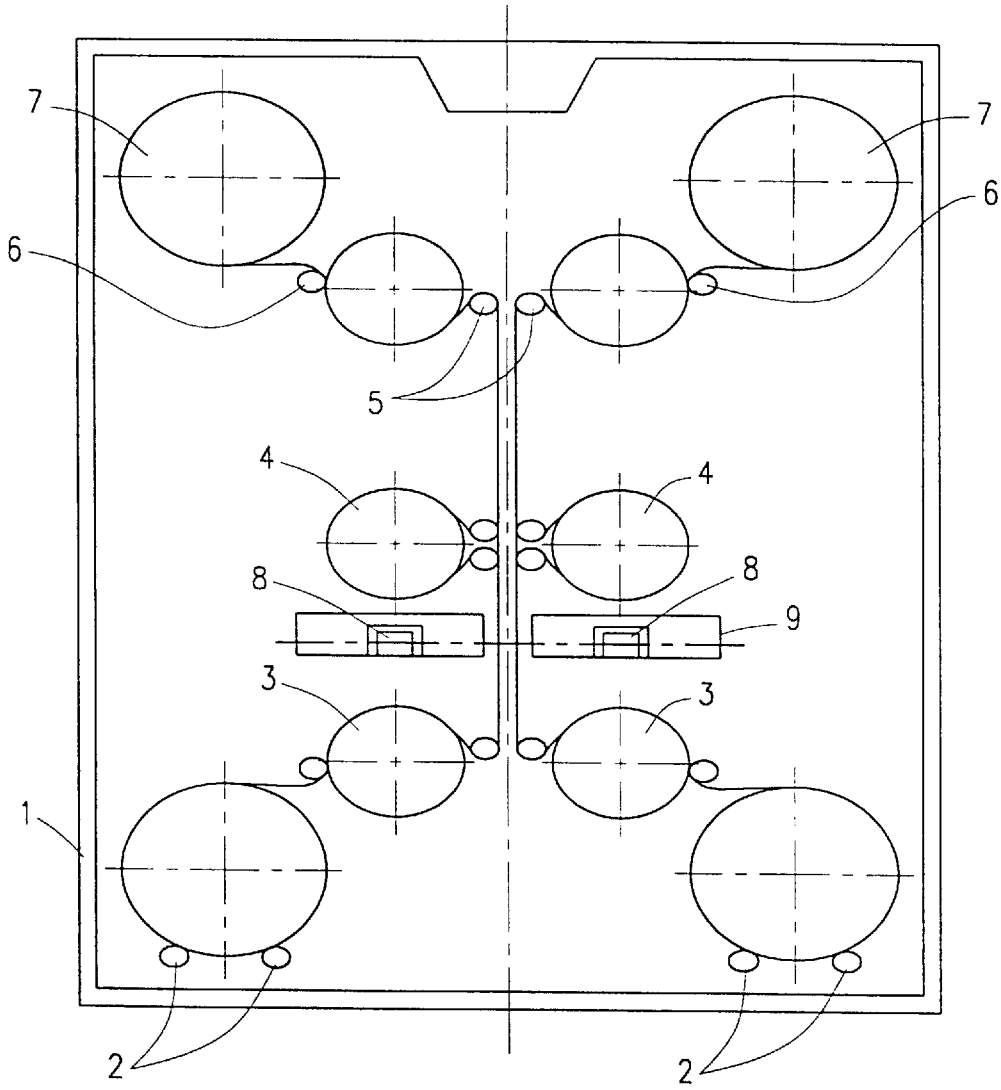

In accordance with commands from the control unit of the device, the feeding shaft (4) moves the substrate one wording step equal to the width of a line of the image being produced. When the position of the carriage (8) in the process of its uniform movement is in the inoperative zones of the device (zones I and II, see FIG. 2), recharging of the carriages with air and ink is carried out, and also information, which should be reproduced on the substrate, is transmitted over the radio channel. When the controller (21), disposed on the carriage, enters the working zone in the process of movement of the carriage, it effects autonomous control of the process of putting the information (in this case by operation of the jet elements) onto the substrate. Upon exit from the working zone, the control unit of the device determines the condition of the device, effects control of the operation of the air and ink recharging systems, effects movement of the substrates, carries out additional servicing actions, determines the working capacity of the device, tests separate units, brings out a message to the operator onto the reproducing system and effects the subsequent operation cycle. Where there is one substrate present, the device in accordance with the described algorithm may effect the structuring of images from two sides, both with the aid of one carriage and with the aid of two or more, and where there are two independent systems for feeding substrates, the device has the possibility of effecting the structuring of images on two substrates. The general diagram of a device with two systems for feeding a substrate and with two carriages is shown in FIG. 5.

Industrial Applicability

The proposed technical solution makes it possible to create large formal printers for producing printed articles, in particular, in the production of outside advertising objects.

Realization of this invention enhances the quality of a produced article (i.e. the quality of an image) and increases the productivity of printers by at least two times.

What is claimed is:

1. A large format ink-jet color printer comprising:

at least one ink feeding mechanism that is movable along a closed guiding rail for moving relative to a substrate;

a printer control unit for sending instructions to said ink feeding mechanism;

a substrate feeding system having a plurality of feeding shafts and a plurality of tensioning shafts, said substrate feeding system for feeding the substrate adjacent to a portion of said guiding rail;

wherein said plurality of feeding shafts are for feeding the substrate into the color printer;

wherein said plurality of tensioning shafts are positioned above and below said feeding shafts for maintaining a desired amount of tension within the substrate; and wherein said plurality of feeding shafts and said plurality of tensioning shafts are positioned so as to maintain the substrate in a generally substantially vertical plane.

2. The large format ink-jet color printer according to claim 1 wherein:

said plurality of tensioning shafts are connected to a first reversible motor with magnetic clutches.

3. The large format ink-jet color printer according to claim 1 wherein:

said guiding rail is adapted to surround the substrate, said closed guiding rail adapted to transfer electric power to said ink feeding mechanism.

4. The large format ink-jet color printer according to claim 1 further comprising:

at least one receiver on said ink feeding mechanism; and at least one rapidly released catch adapted to intermittently communicate with said receiver for delivering air to said receiver.

5. The large format ink-jet color printer according to claim 1 further comprising:

a controller on said ink feeding mechanism, said controller controls operation of said ink feeding mechanism, said controller is provided with a transceiver that receives signals from said printer control unit and transmits signals to said printer control unit;

a hatched ruler on said guiding rail; and at least one optical sensor on said ink feeding mechanism for reading said hatched ruler to determine the exact position of said ink feeding mechanism, said optical sensor in communication with said controller.

6. The large format ink-jet color printer according to claim 1 further comprising:

a least one charging cartridge on said ink feeding mechanism for receiving ink;

an electronic controller on said ink feeding mechanism for receiving instructions from said printer control unit;

at least one electrical valve on said charging cartridge for receiving instructions from said electronic controller; and at least one rapidly-released catch adapted to intermittently engage said charging cartridge for recharging said charging cartridge, said rapidly released catch positioned proximate said guiding rail.

7. The large format ink-jet color printer according to claim 6, wherein:

said charging cartridge has a level sensor in communication with said electronic controller.

8. The large format ink-jet color printer according to claim 1, wherein:

said plurality of feeding shafts and said plurality of tensioning shafts comprise a first substrate feeding system; and further comprising a second substrate feeding system, independent of said first substrate feeding system, wherein said first substrate feeding system and said second substrate feeding system each feed a substrate within said closed guiding rail.

9. A large format ink-jet color printer comprising:

a closed guiding rail adapted to surround a substrate; and at least one ink feeding mechanism that is movable along said closed guiding rail relative to the substrate, wherein said ink feeding mechanism receives electrical power from said closed guiding rail.

10. The large format ink-jet color printer according to claim 9 further comprising:

at least one receiver on said ink feeding mechanism; and at least one rapidly released catch proximate said closed guiding rail, said rapidly released catch adapted to intermittently communicate with said receiver for delivering air to said receiver.

11. The large format ink-jet color printer according to claim 9 further comprising:

a controller on said ink feeding mechanism, said controller controls operation of said ink feeding mechanism, said controller is provided with a transceiver that receives signals from said printer control unit and transmits signals to said printer control unit;

a hatched ruler on said closed guiding rail; and at least one optical sensor on said ink feeding mechanism for reading said hatched ruler to determine the exact position of said ink feeding mechanism, said optical sensor in communication with said controller.

12. The large format ink-jet color printer according to claim 9 further comprising:

a printer control unit for sending instructions to said ink feeding mechanism;

at least one charging cartridge on said ink feeding mechanism for receiving ink;

an electronic controller on said ink feeding mechanism for receiving instructions from said printer control unit;

at least one electrical valve mounted on said charging cartridge for receiving instructions from said electronic controller; and at least one rapidly-released catch adapted to intermittently engage said charging cartridge for recharging said charging cartridge, said rapidly released catch positioned proximate said guiding rail.

13. The large format ink-jet color printer according to claim 9, further comprising:

a substrate feeding system having a plurality of feeding shafts and a plurality of tensioning shafts, said substrate feeding system for feeding the substrate adjacent to a portion of said closed guiding rail;

wherein said plurality of feeding shafts are for feeding the substrate into the color printer;

wherein the plurality of tensioning shafts are positioned above and below said feeding shafts for maintaining a desired amount of tension within the substrate; and wherein said plurality of feeding shafts and said plurality of tensioning shafts are positioned so as to maintain the substrate in a generally substantial vertical plane.

14. The large format ink-jet color printer according to claim 13, wherein:

said plurality of feeding shafts and said plurality of tensioning shafts comprise a first substrate feeding system; and further comprising a second substrate feeding system, independent of said first substrate feeding system, wherein said first substrate feeding system and said second substrate feeding system each feed a substrate within said closed guiding rail.

15. A large format ink-jet color printer comprising:

a closed guiding rail;

at least one ink feeding mechanism movable along said guiding rail relative to said substrate, wherein said ink feeding mechanism receives electrical power from said guiding rail;

a printer control unit for sending instructions to said ink feeding mechanism;

at least one receiver on said ink feeding mechanism; and at least one rapidly released catch adapted to intermittently communicate with said receiver for delivering air to said receiver.

16. The large format ink-jet color printer according to claim 15 further comprising:

a substrate feeding system having a plurality of feeding shafts and a plurality of tensioning shafts, said substrate feeding system for feeding the substrate adjacent to a portion of said guiding rail;

wherein said plurality of feeding shafts are for feeding the substrate into the color printer;

wherein the plurality of tensioning shafts are positioned above and below said feeding shafts for maintaining a desired amount of tension within the substrate; and wherein said plurality of feeding shafts and said plurality of tensioning shafts are positioned so as to maintain the substrate in a generally substantial vertical plane.

17. The large format ink-jet color printer according to claim 15 wherein:

said closed guiding rail is adapted to surround the substrate, said closed guiding rail adapted to transfer electric power to said ink feeding mechanism.

18. The large format ink-jet color printer according to claim 15, wherein said at least one rapidly released catch is proximate said guiding rail, said rapidly released catch being adapted to intermittently communicate with said receiver for delivering air to said receiver.

19. The large format ink-jet color printer according to claim 15 further comprising:

a controller on said ink feeding mechanism, said controller controls operation of said ink feeding mechanism, said controller is provided with a transceiver that receives signals from said printer control unit and transmits signals to said printer control unit;

a hatched ruler on said guiding rail; and at least one optical sensor on said ink feeding mechanism for reading said hatched ruler to determine the exact position of said ink feeding mechanism, said optical sensor in communication with said controller.

20. The large format ink-jet color printer according to claim 15 further comprising:

at least one charging cartridge on said ink feeding mechanism for receiving ink;

an electronic controller on said ink feeding mechanism, said controller controls operation of said ink feeding mechanism, said controller is provided with a transeiver that receives signals from said printer control unit and transmits signals to said printer control unit;

at least one electrical valve mounted on said charging cartridge for receiving instructions from said electronic controller; and wherein said at least one rapidly-released catch is adapted to intermittently engage said charging cartridge for recharging said charging cartridge, said rapidly released catch being positioned proximate said guiding rail.

21. The large format ink-jet color printer according to claim 15, wherein said guiding rail is adapted to surround the substrate.

22. A large format ink-jet color printer including:

a closed guiding rail;

at least one ink feeding mechanism movable along said guiding rail relative to a substrate, wherein said ink feeding mechanism receives electrical power from said guiding rail;

a printer control unit for sending instructions to said ink feeding mechanism; and a controller on said ink feeding mechanism that receives signals from said printer control unit and which controls operation of said ink feeding mechanism.

23. The large format ink-jet color printer according to claim 22 further comprising:

a substrate feeding system having a plurality of feeding shafts and a plurality of tensioning shafts, said substrate feeding system for feeding the substrate adjacent to a position of said guiding rail;

wherein said plurality of feeding shafts are for feeding the substrate into the color printer;

wherein the plurality of tensioning shafts are positioned above and below said feeding shafts for maintaining a desired amount of tension within the substrate; and wherein said plurality of feeding shafts and said plurality of tensioning shafts are positioned so as to maintain the substrate in a generally substantial vertical plane.

24. The large format ink-jet color printer according to claim 23, wherein:

said plurality of feeding shafts and said plurality of tensioning shafts comprise a first substrate feeding system; and further comprising a second substrate feeding system, independent of said first substrate feeding system, wherein said first substrate feeding system and said second substrate feeding system each feed a substrate within said closed guiding rail.

25. The large format ink-jet color printer according to claim 22 wherein:

said guiding rail is adapted to surround the substrate, said closed guiding rail adapted to transmit electric power.

26. The large format ink-jet color printer according to claim 22 further comprising:

at least one receiver on said ink feeding mechanism; and at least one rapidly released catch positioned to intermittently communicate with said receiver for delivering air to said receiver.

27. The large format ink-jet color printer according to claim 22 further comprising:

a controller on said ink feeding mechanism, said controller controls operation of said ink feeding mechanism, said controller is provided with a transceiver that receives signals from said printer control unit and transmits signals to said printer control unit;

a hatched ruler on said guiding rail; and at least one optical sensor on said ink feeding mechanism for reading said hatched ruler to determine the exact position of said ink feeding mechanism, said optical sensor in communication with said controller.

28. The large format ink-jet color printer according to claim 22 further comprising:

at least one charging cartridge on said ink feeding mechanism for receiving ink;

an electronic controller on said ink feeding mechanism for receiving instructions from said printer control unit;

at least one electrical valve on said charging cartridge for receiving instructions from said electronic controller; and at least one rapidly-released catch adapted to intermittently engage said charging cartridge for recharging said charging cartridge, said rapidly released catch positioned proximate said guiding rail.

29. A large format ink-jet color printer comprising:

a closed guiding rail;

at least one ink feeding mechanism that is movable along said closed guiding rail for moving relative to a substrate;

a printer control unit for sending instructions to said ink feeding mechanism;

a controller on said ink feeding mechanism, said controller receives signals from said printer control unit, said controller controls operation of said ink feeding mechanism;

a hatched ruler on said guiding rail; and at least one sensor on said ink feeding mechanism for reading said hatched ruler to determine an exact position of said ink feeding mechanism, said sensor in communication with said controller.

30. The large format ink-jet color printer according to claim 29, wherein said sensor is an optical sensor.

31. The large format ink-jet color printer according to claim 29, further comprising:

a substrate feeding system having a plurality of feeding shafts and a plurality of tensioning shafts, said substrate feeding system for feeding the substrate adjacent to a position of said guiding rail;

wherein said plurality of feeding shafts are for feeding the substrate into the color printer;

wherein said plurality of tensioning shafts are positioned above and below said feeding shafts for maintaining a desired amount of tension within the substrate; and wherein said plurality of feeding shafts and said plurality of tensioning shafts are positioned so as to maintain the substrate in a generally substantial vertical plane.

32. The large format ink-jet color printer according to claim 31, wherein:

said plurality of feeding shafts and said plurality of tensioning shafts comprise a first substrate feeding system; and further comprising a second substrate feeding system, independent of said first substrate feeding system, wherein said first substrate feeding system and said second substrate feeding system each feed a substrate within said closed guiding rail.

33. The large format ink-jet color printer according to claim 29 wherein:

said guiding rail is adapted to surround the substrate, said closed guiding rail adapted to transfer electric power to said ink feeding mechanism.

34. The large format ink-jet color printer according to claim 29 further comprising:

at least one receiver on said ink feeding mechanism; and at least one rapidly released catch positioned to intermittently communicate with said receiver for delivering air to said receiver.

35. The large format ink-jet color printer according to claim 29 further comprising:

a controller on said ink feeding mechanism, said controller controls operation of said ink feeding mechanism, said controller is provided with a transceiver that receives signals from said printer control unit and transmits signals to said printer control unit;

a hatched ruler on said guiding rail; and at least one optical sensor on said ink feeding mechanism for reading said hatched ruler to determine the exact position of said ink feeding mechanism, said optical sensor in communication with said controller.

36. The large format ink-jet color printer according to claim 29 further comprising:

at least one charging cartridge on said ink feeding mechanism for receiving ink;

an electronic controller on said ink feeding mechanism, said controller controls operation of said ink feeding mechanism, said controller is provided with a transceiver that receives signals from said printer control unit and transmits signals to said printer control unit;

at least one electrical valve mounted on said charging cartridge for receiving instructions from said electronic controller; and at least one rapidly-released catch adapted to intermittently engage said ink cartridge for recharging said ink cartridge, said rapidly released catch positioned proximate where said guiding rail turns.

37. A large format ink-jet color printer comprising:

a closed guiding rail;

at least one ink feeding mechanism that is movable along said guiding rail for moving relative to a substrate;

a printer control unit for sending instructions to said ink feeding mechanism;

at least one charging cartridge on said ink feeding mechanism for receiving ink;

an electronic controller on said ink feeding mechanism for receiving instructions from said printer control unit;

at least one electrical valve on said charging cartridge for receiving instructions from the electronic controller; and at least one rapidly-released catch adapted to intermittently engage said charging cartridge for recharging said charging cartridge, said rapidly-released catch positioned proximate said guiding rail.

38. The large format ink-jet color printer according to claim 37 comprising:

a substrate feeding system having a plurality of feeding shafts and a plurality of tensioning shafts, said substrate feeding system for feeding the substrate adjacent to a portion of said guiding rail;

wherein said plurality of feeding shafts are for feeding the substrate into the color printer;

wherein the plurality of tensioning shafts are positioned above and below said feeding shafts for maintaining a desired amount of tension within the substrate; and wherein said plurality of feeding shafts and said plurality of tensioning shafts are positioned so as to maintain the substrate in a generally substantial vertical plane.

39. The large format ink-jet color printer according to claim 38, wherein:

said plurality of feeding shafts and said plurality of tensioning shafts comprise a first substrate feeding system; and further comprising a second substrate feeding system, independent of said first substrate feeding system, wherein said first substrate feeding system and said second substrate feeding system each feed a substrate within said closed guiding rail.

40. The large format ink-jet color printer according to claim 37 wherein:

said guiding rail is adapted to surround the substrate, said closed guiding rail adapted to transfer electric power to said ink feeding mechanism.

41. The large format ink-jet color printer according to claim 37 further comprising at least one receiver on said ink feeding mechanism; and wherein said at least one rapidly-released catch is positioned to intermittently communicate with said receiver for delivering air to said receiver.

42. The large format ink-jet color printer according to claim 37 further comprising:

a controller on said ink feeding mechanism, said controller controls operation of said ink feeding mechanism, said controller is provided with a transceiver that receives signals from said printer control unit and transmits signals to said printer control unit;

a hatched ruler on said guiding rail; and at least one optical sensor on said ink feeding mechanism for reading said hatched ruler to determine the exact position of said ink feeding mechanism, said optical sensor in communication with said controller.

43. The large format ink-jet color printer according to claim 37, further comprising:

an electronic controller on said ink feeding mechanism, said controller controls operation of said ink feeding mechanism, said controller is provided with a transceiver that receives signals from said printer control unit and transmits signals to said printer control unit;

at least one electrical valve mounted on said charging cartridge for receiving instructions from said electronic controller.

44. A large format ink-jet colour printer comprising:

a first substrate feeding system;

an ink feeding mechanism movable along a guiding rail relative to a substrate;

a printer control unit;

wherein shafts in the substrate feeding system are positioned in a vertical plane;

wherein tensioning shafts connected to reversible motors via magnetic clutches are positioned above and below feeding shafts provided with one of said reversible motors;

wherein the ink feeding mechanism is provided with:

at least one carriage adapted to supply electric power;

a receiver adapted to be filled with air via a rapidly-released catch;

a controller in electrical communication with a transceiver; and an optical sensor electrically coupled to the controller wherein the guiding rail is provided with busbars for supplying electric power and with a hatched ruler for exactly positioning the carriage;

wherein electrical valves connected to the printer control unit are mounted on charging cartridges for ink;

wherein the charging cartridges are positioned on the carriage and have a level sensor; and wherein the rapidly-released catches are adapted to recharge ink cartridges and are positioned in places where the guiding rail turns.

45. The large format ink-jet color printer of claim 44, comprising:

a second substrate feeding system, independent of the first substrate feeding system;

wherein both the first substrate feeding system and the second substrate feeding system are positioned substantially parallel to one another; and wherein the first substrate feeding system and the second substrate feeding system are encompassed by the guiding rail.

* * * * *